US012152340B2

(12) United States Patent
Chen

(10) Patent No.: US 12,152,340 B2
(45) Date of Patent: Nov. 26, 2024

(54) HIGH-CAPACITY LAUNDRY BAG CONVENIENT FOR DRAGGING AND TAKING CLOTHES, AND FOLDABLE FOR STORAGE

(71) Applicant: Guanxin Chen, Guangzhou (CN)

(72) Inventor: Guanxin Chen, Guangzhou (CN)

( * ) Notice: Subject to any disclaimer, the term of this patent is extended or adjusted under 35 U.S.C. 154(b) by 157 days.

(21) Appl. No.: 17/936,123

(22) Filed: Sep. 28, 2022

(65) Prior Publication Data

US 2024/0076827 A1 Mar. 7, 2024

(30) Foreign Application Priority Data

Sep. 7, 2022 (CN) ..... 202222372642.7

(51) Int. Cl.
*D06F 95/00* (2006.01)

(52) U.S. Cl.
CPC ..... *D06F 95/004* (2013.01)

(58) Field of Classification Search
CPC ... D06F 95/004; A45C 7/0036; A45C 7/0077; A45C 13/385; A45C 13/262; A45C 13/28
See application file for complete search history.

(56) References Cited

U.S. PATENT DOCUMENTS

| | | | | |
|---|---|---|---|---|
| 6,443,274 | B1 * | 9/2002 | Klamm | A45C 7/0077 190/127 |
| 6,805,225 | B2 * | 10/2004 | Freedman | A45C 15/00 220/495.05 |
| 7,232,018 | B1 * | 6/2007 | Salander | A45C 5/14 280/37 |
| 8,327,719 | B2 * | 12/2012 | Rieder | G01F 1/8495 73/861.357 |
| D688,449 | S * | 8/2013 | Schinasi | D3/232 |
| 11,910,897 | B2 * | 2/2024 | Libuda | A45C 5/14 |
| 2013/0175130 | A1 * | 7/2013 | Liang | A45C 3/00 190/18 A |
| 2016/0262509 | A1 * | 9/2016 | Chaffee | A45C 13/103 |

* cited by examiner

*Primary Examiner* — Tri M Mai
(74) *Attorney, Agent, or Firm* — Daniel M. Cohn; Howard M. Cohn

(57) ABSTRACT

A high-capacity laundry bag convenient for dragging and taking clothes, and foldable for storage, includes a bag body. The laundry bag further includes a bottom pull window convenient for reaching out for clothes, disposed on a side of a bottom of the bag body, a capacity expansion layer capable of expanding clothes holding capacity, disposed at a top of the bag body, and a rolling wheel capable of supporting and moving the bag body, disposed at the bottom of the bag body.

6 Claims, 10 Drawing Sheets

HIGH-CAPACITY LAUNDRY BAG CONVENIENT FOR DRAGGING AND TAKING CLOTHES, AND FOLDABLE FOR STORAGE

TECHNICAL FIELD

The present disclosure relates to a field of laundry bags, and in particular to a high-capacity laundry bag convenient for dragging and taking clothes, and foldable for storage.

BACKGROUND

Laundry bags are bags configured to carry dirty clothes to washing machines or a laundry for cleaning. Conventional laundry bags are ordinary bags with cavities, which are closed by zippers on top and are equipped with straps. However, when there are too many clothes, it is necessary to take out clothes at an entire one of an upper end of the laundry bag if you want to take out a piece of clothes located at a bottom of the laundry bag solely. Moreover, the conventional laundry bags cannot be dragged, but only be carried with the straps or handles. In addition, when the laundry bags are empty, bag bodies of the laundry bags cannot stand on their own, which is very inconvenient. Finally, when the laundry bags are delivered by manufacturers or not used by users temporarily, the laundry bags need to be folded for storage. How to quickly fold and store the laundry bags is also a technical problem.

SUMMARY

In order to overcome shortcomings of the prior arts, the present disclosure aims to provide a high-capacity laundry bag convenient for dragging and taking clothes, and foldable for storage, which can also stand independently while being empty, so as to solve the technical problems mentioned in the background technology.

To solve the technical problems, the present disclosure adopts following technical solutions.

The present disclosure provides a high-capacity laundry bag convenient for dragging and taking clothes, and foldable for storage, including a bag body, wherein the laundry bag further comprises a bottom pull window convenient for reaching out for clothes, disposed on a side of a bottom of the bag body, a capacity expansion layer capable of expanding clothes holding capacity, disposed at a top of the bag body, and rolling wheels capable of supporting and moving the bag body, disposed at the bottom of the bag body.

Furthermore, the laundry bag comprises a detachable base disposed at the bottom of the bag body, the rolling wheels are arranged at a bottom of the base, and the laundry bag further comprises a first hook-and-loop fastener disposed at the base, and a second hook-and-loop fastener disposed at the bottom of the bag body correspondingly to the first hook-and-loop fastener, and closure of the capacity expansion layer is performed through an elastic rope.

Furthermore, the laundry bag comprises support rings disposed at inner layers of an upper end and a lower end of each sidewall of the bag body, the support rings are capable of providing support when the bag body is unfolded, and the support rings are capable of rotating and folding between adjacent two of the support rings when the bag body is to be folded for storage, so as to finally realize folding for storage of an entire one of the bag body.

Furthermore, the laundry bag comprises a trolley disposed at a back of the bag body, and a trolley holding belt capable of preventing a body of the trolley from shaking disposed at an upper part of the bag body correspondingly to the trolley.

Furthermore, the laundry bag comprises a first connector disposed on the base, and a second connector capable of being movably connected to the first connector disposed at the bottom of the bag body correspondingly to the first connector, and the base and the bag body are capable of being locked via the first connector and the second connector after being fixed by the first hook-and-loop fastener and the second hook-and-loop fastener to prevent the bag body from detaching or falling from the base.

Furthermore, the first connector is a male button portion of a latch, and the second connector is a female button portion of the latch.

Furthermore, the laundry bag comprises a main handle disposed at an upper end of the bag body, and a side handle disposed on a different side from the main handle of the bag body, and the main handle is connected to a connecting buckle capable of tightening the bag body and the capacity expansion layer after being filled up with clothes to prevent the top of the laundry bag from loosening.

Furthermore, the laundry bag further comprises a strap located in the back of the bag body, and the main handle is disposed at an upper end of the strap.

Furthermore, closure of the bottom pull window is realized via a first zipper.

Furthermore, the laundry bag comprises a side bag disposed on an outer side of the bottom pull window, and closure of the side bag is realized via a second zipper.

Compared with the prior arts, beneficial effects of the present disclosure are as following.

(1) It is possible for the laundry bag to receive clothes of large capacity, to be dragged and make clothes taking convenient by configuring the rolling wheels, the detachable base, the bottom pull window, and the capacity expansion layer.

(2) By configuring at least two of the support rings (rounded rectangular steel rings) on each side wall, it is capable of folding between the adjacent two of the support rings, and with the detachable base, the folding for storage of the laundry bag can be realized.

(3) By configuring the first connector and the second connector, the bag body and the base can be strengthened, and by configuring the side handle at the top and adding the connection buckle on the side handle for tightening, loosening of the top of the bag body is prevented.

Figure 1:
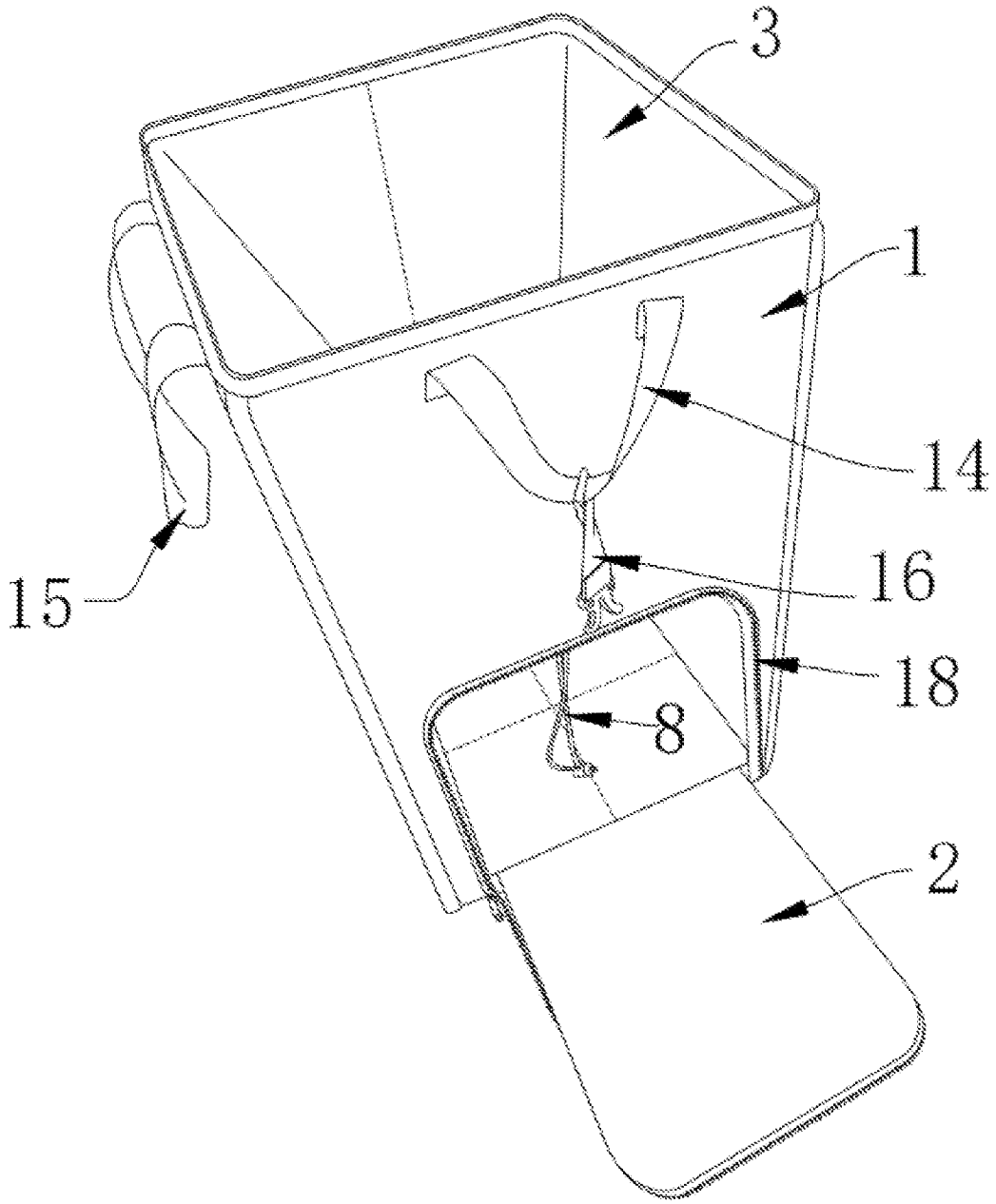
FIG. 1 is a first overall structural diagram of the laundry bag of the present disclosure (in which the capacity expansion layer is hidden inside).

Reference Number: bag body 1, bottom pull window 2, capacity expansion layer 3, rolling wheel 4, base 5, first hook-and-loop fastener 6, second hook-and-loop fastener 7, elastic rope 8, supporting ring 9, trolley 10, trolley holding belt 11, first connector 12, second connector 13, main handle 14, side handle 15, connecting buckle 16, strap 17, first zipper 18, second zipper 19.

DETAILED DESCRIPTION OF PREFERRED EMBODIMENTS

The present disclosure will be further described in detail with reference to the accompanying drawings and embodiments. It should be noted that, in the absence of conflict, a new embodiment may be formed by any combination between the embodiments or between the technical features described below.

Figure 2:
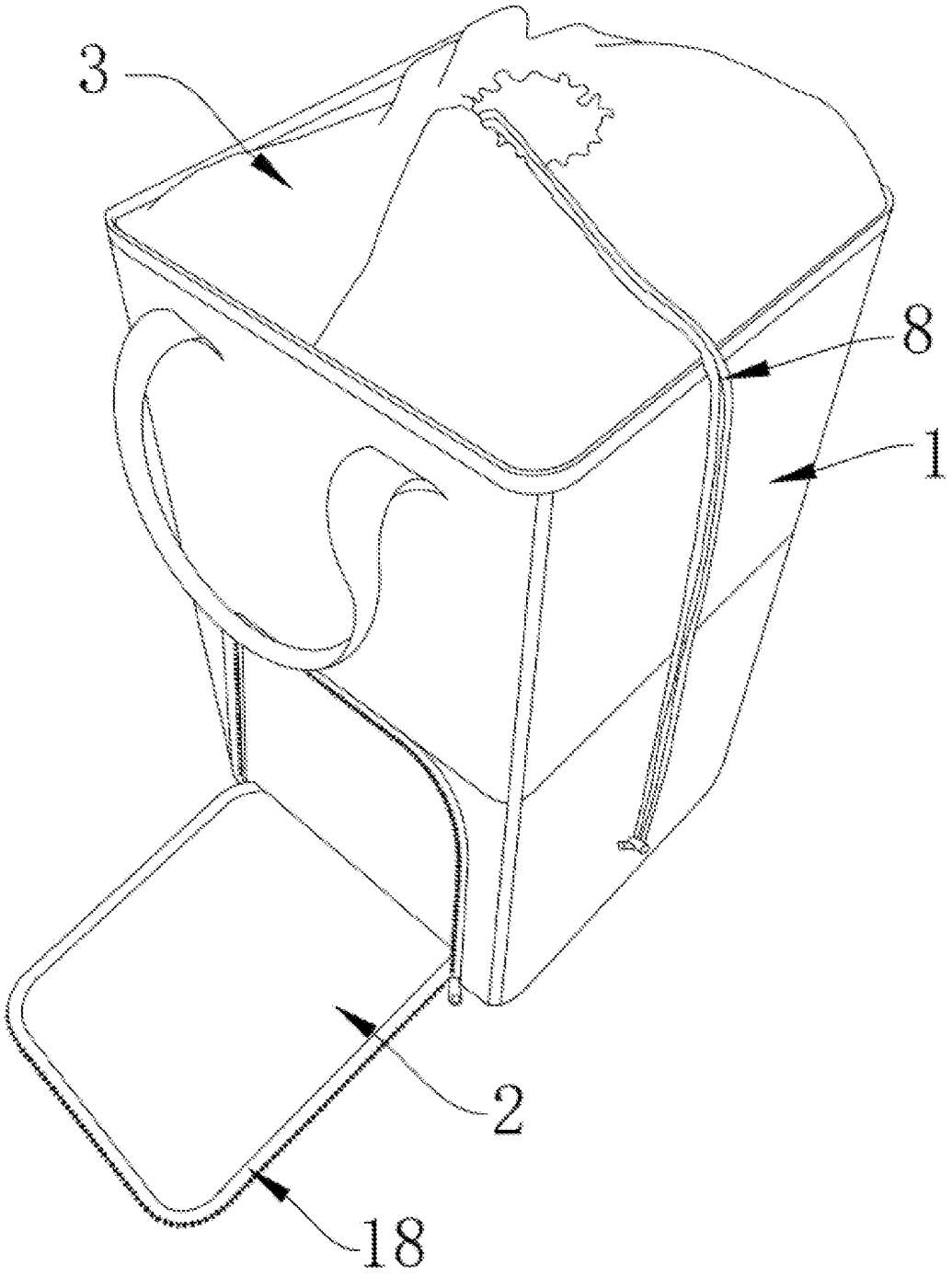
FIG. 2 is a second overall structural diagram of the laundry bag of the present disclosure (in which the capacity expansion layer is jacking up outward and closed by the elastic rope).
Figure 3:
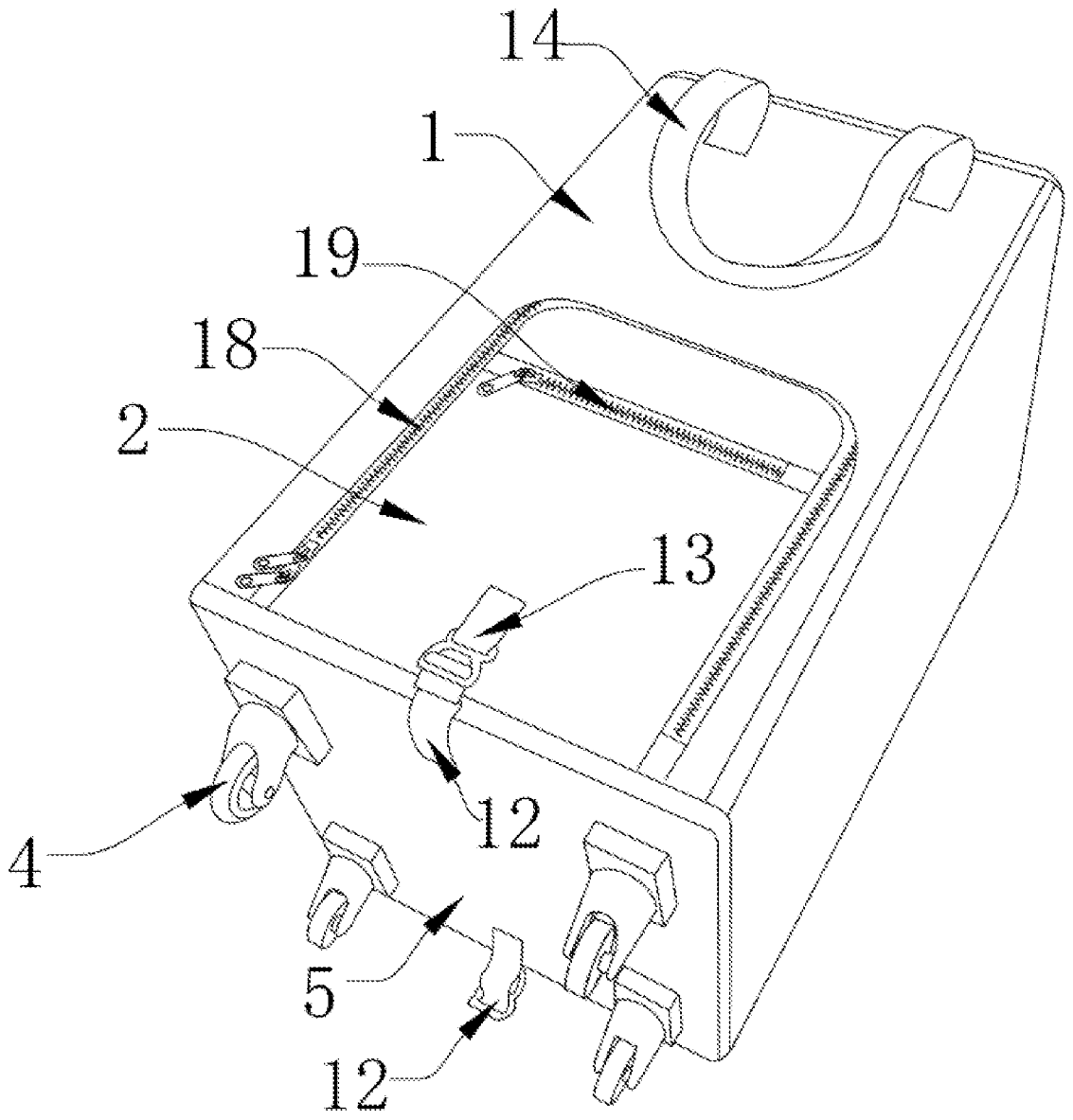
FIG. 3 is a third overall structural diagram of the laundry bag of the present disclosure (in which the base is locked up with and connected to the bag body).
Figure 4:
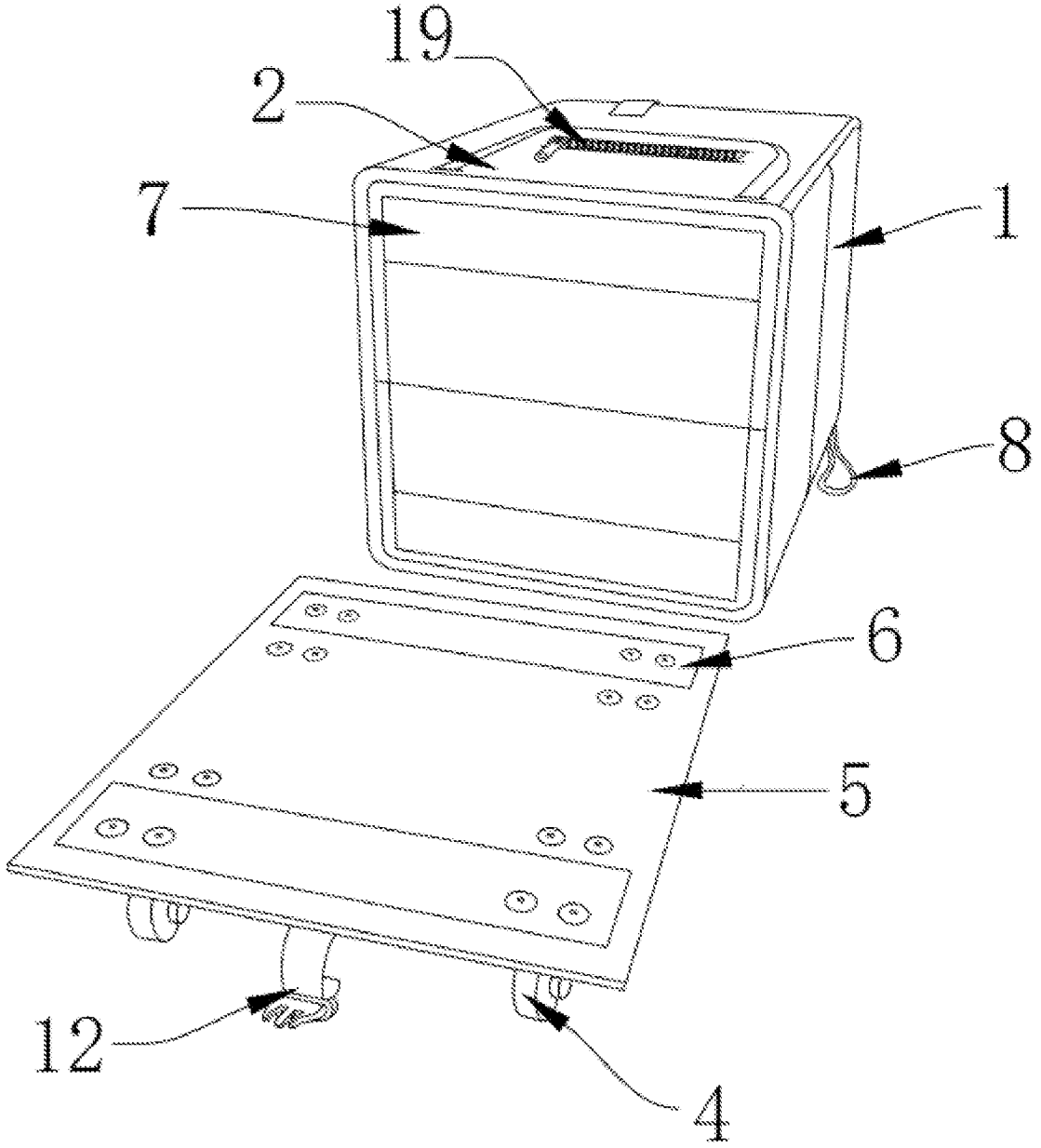
FIG. 4 is a fourth overall structural diagram of the laundry bag of the present disclosure (in which the base is locked up with and connected to the bag body).
Figure 5:
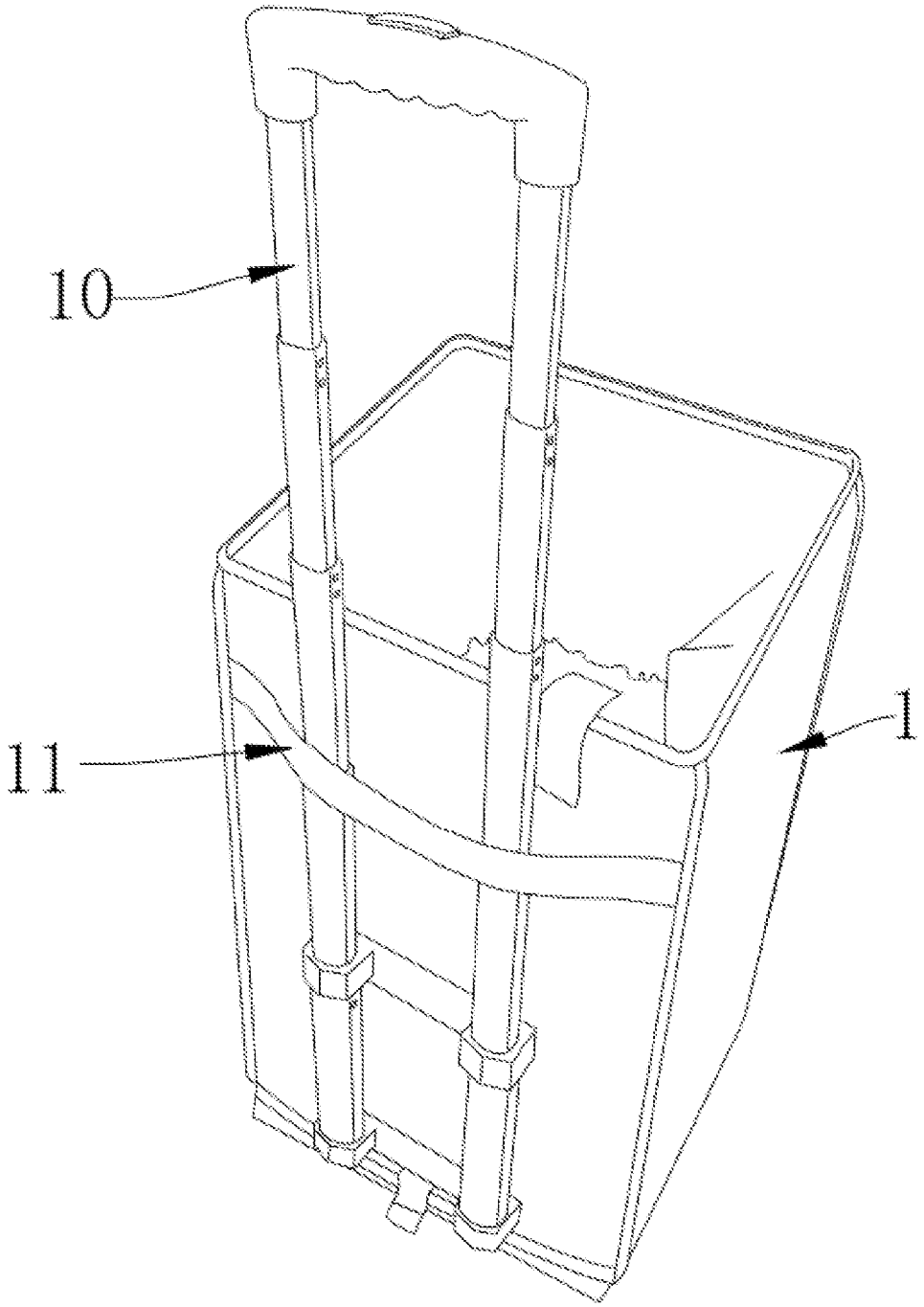
FIG. 5 is a structural diagram of a laundry bag with a trolley of one embodiment of the present disclosure.
Figure 6:
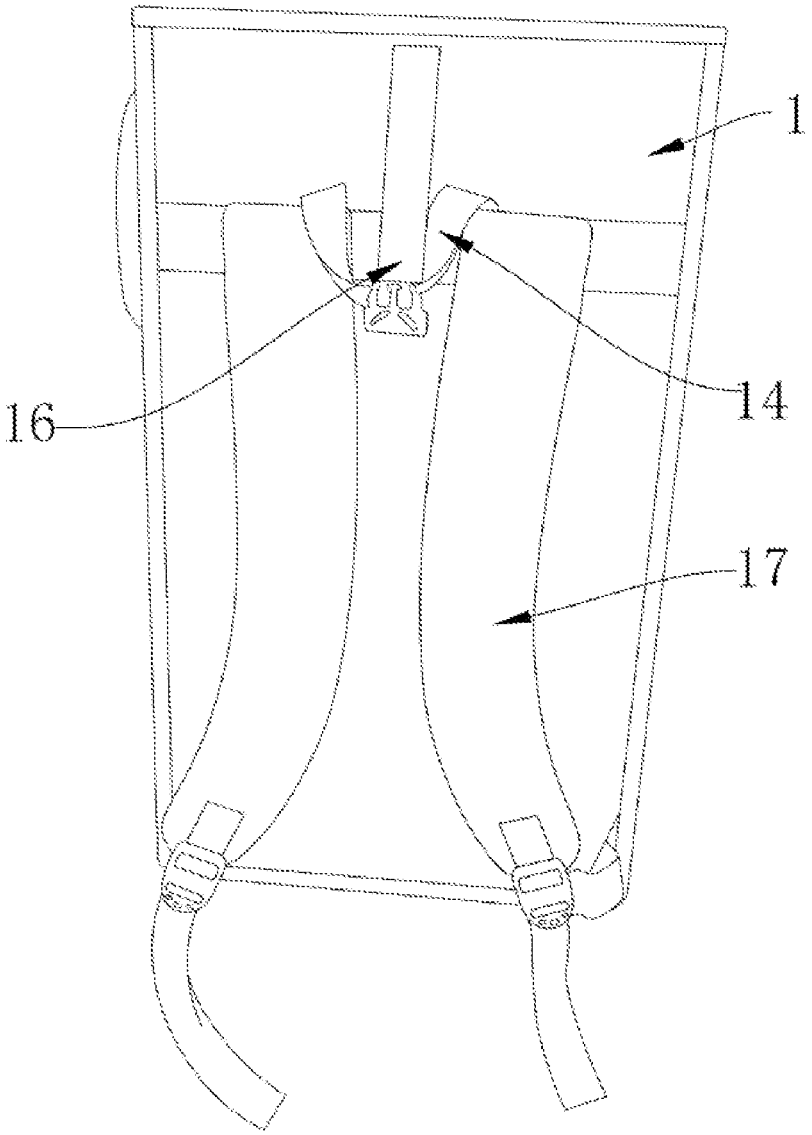
FIG. 6 is a structural diagram of a laundry bag with a strap of one embodiment of the present disclosure.
Figure 7:
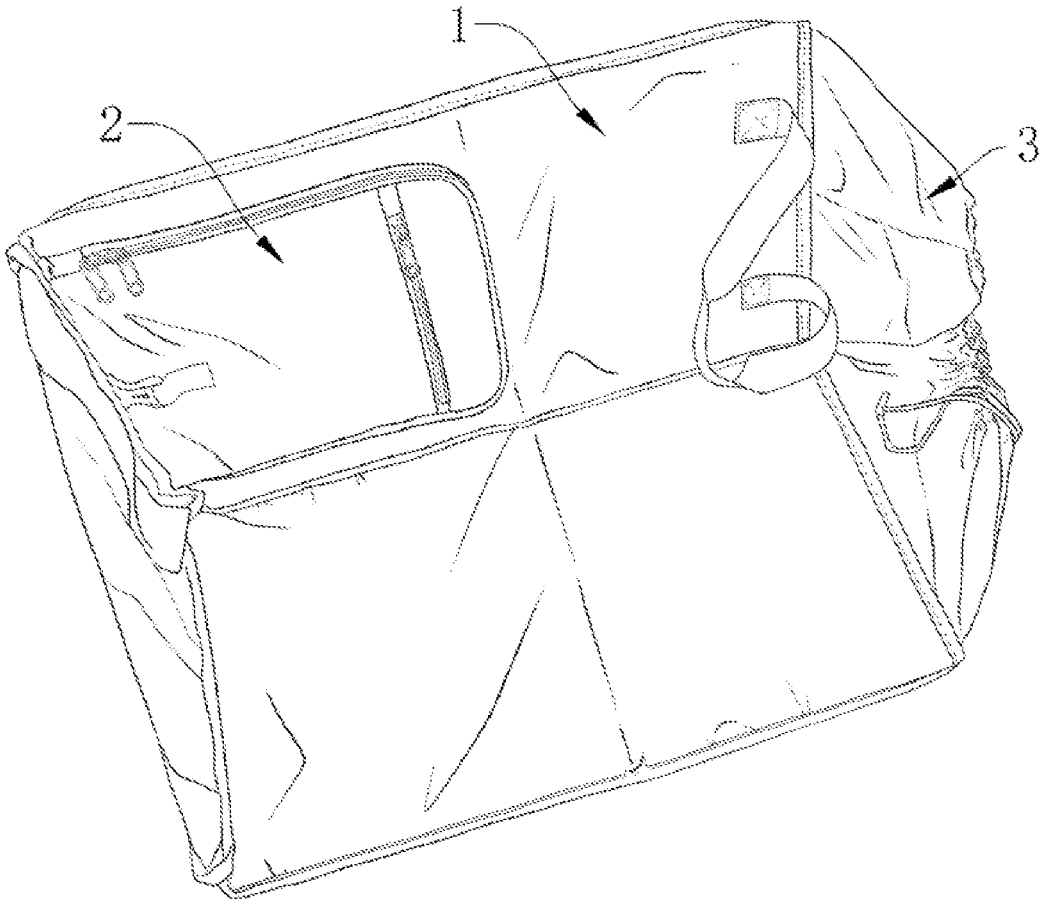
FIG. 7 is a structural diagram showing that sidewalls of a bag body are folded in pairs while being folded for storage in one embodiment of the present disclosure.
Figure 8:
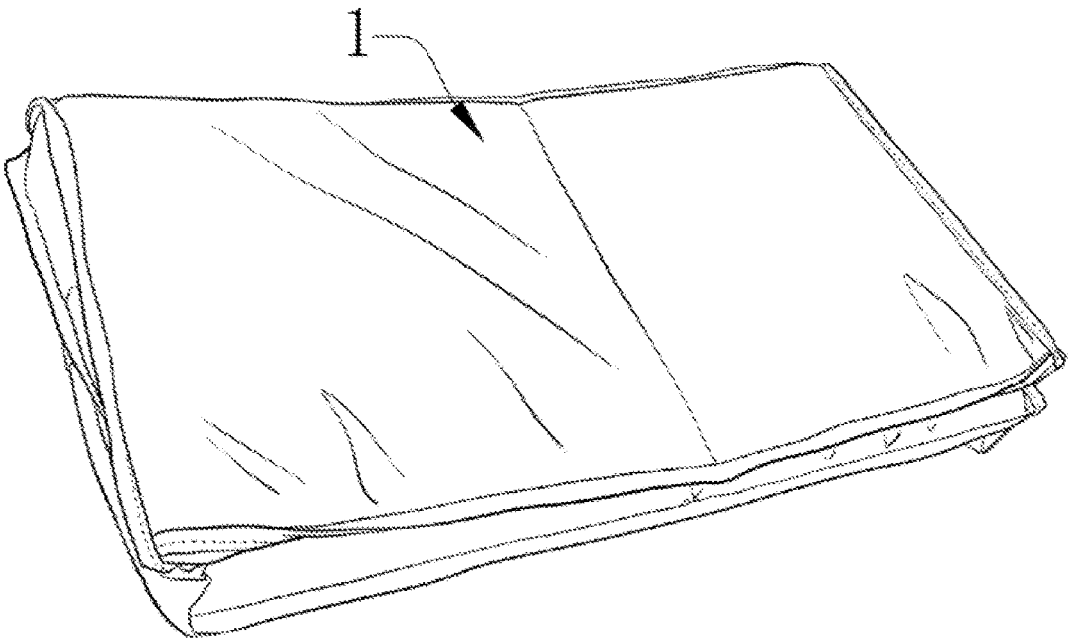
FIG. 8 is a structural diagram showing that the sidewalls of the bag body are further folded in half after being folded in pairs while being folded for storage in the one embodiment of the present disclosure.
Figure 9:
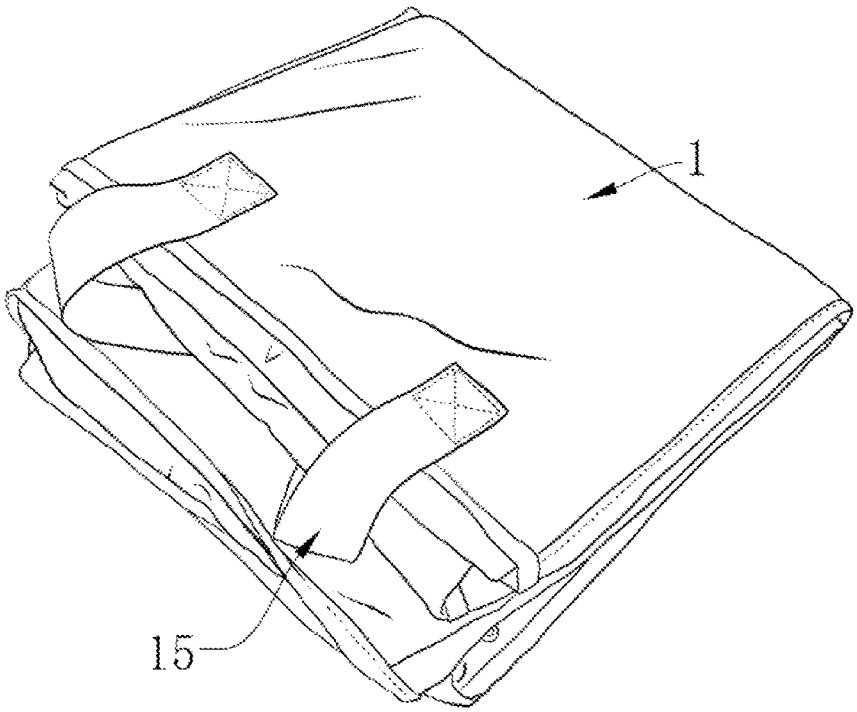
FIG. 9 is a structural diagram showing that the sidewalls of the bag body are folded in pairs after being folded twice while being folded for storage in the one embodiment of the present disclosure.
Figure 10:
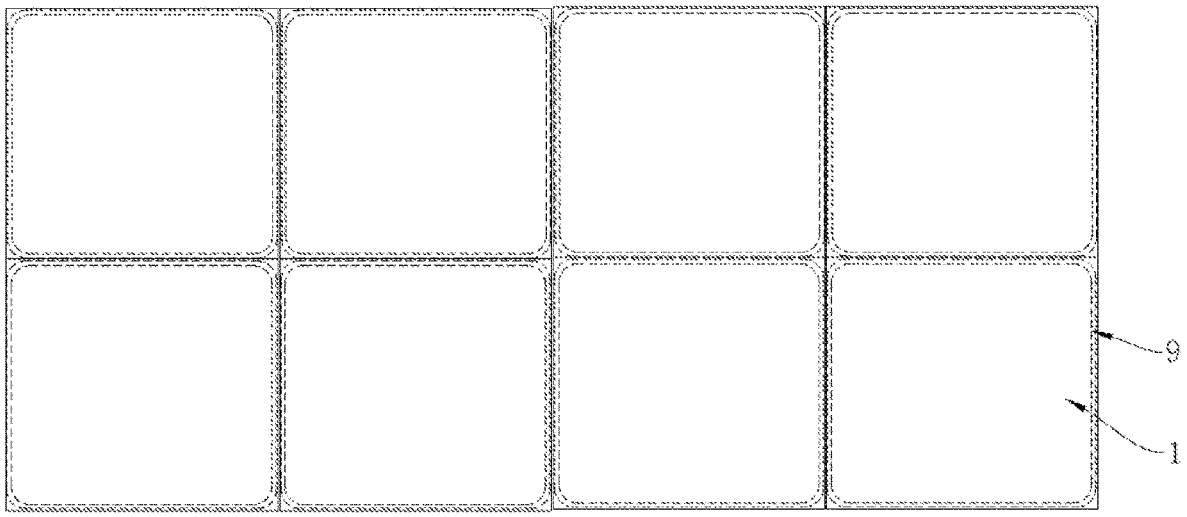
FIG. 10 is a distribution diagram of support rings on four side walls of the bag body in the one embodiment of the present disclosure (in which parts shown in dashed line are the support rings).
Figure 11:
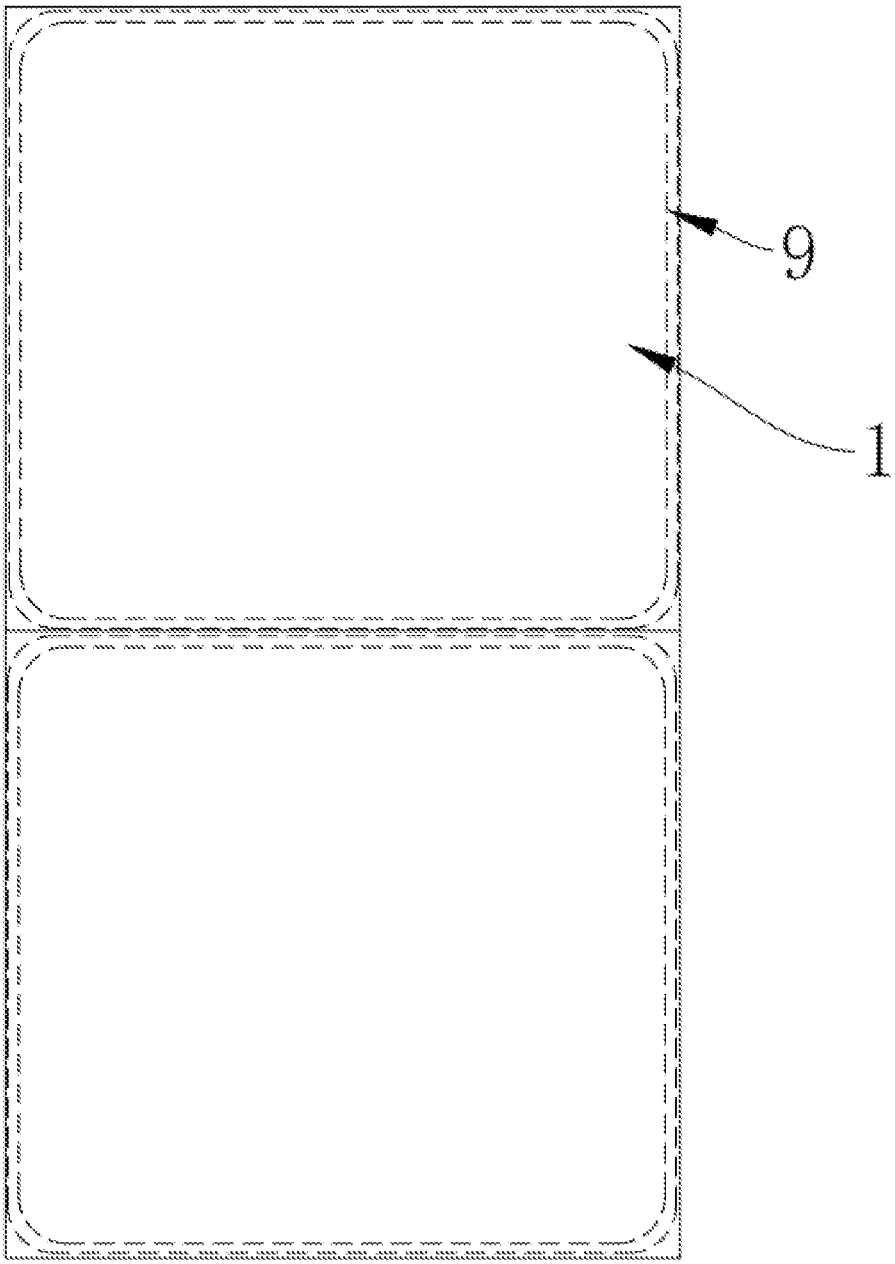
FIG. 11 is a distribution diagram of support rings on one of the four side walls of the bag body in the one embodiment of the present disclosure (in which parts shown in dashed line are the support rings).

Referring to FIG. 1 to FIG. 11:

Embodiment 1: the present disclosure discloses a high-capacity laundry bag convenient for dragging and taking clothes, and foldable for storage, including bag body 1, and a bottom pull window 2 convenient for reaching out for clothes, disposed on a side of a bottom of the bag body 1. Comparing to conventional laundry bags in which clothes can only be taken from top, the bottom pull window 2 make it convenient for users to take clothes from bottom. Closure of the bottom pull window 2 is realized via a first zipper 18, preferably, the first zipper 18 is a U-shaped zipper, basing on this configuration, an opening area of the bottom pull window 2 becomes greater. The laundry bag 1 includes a capacity expansion layer 3 capable of expanding clothes holding capacity, disposed at a top of the bag body 1, and rolling wheels 4 capable of supporting and moving the bag body 1, disposed at the bottom of the bag body 1. Herein, the capacity expansion layer 3 can be used when there are too much clothes for the laundry bag 1 in normal times. Preferably, four sides of a lining of the capacity expansion layer 3 are sewn on an upper end of the bag body 1, a center of the capacity expansion layer 3 is closed with an elastic rope 8, and the capacity expansion layer 3 can be closed with an elastic buckle additionally, or tied with a slip knot directly, which is very convenient. With aid of the capacity expansion layer 3, after the bag body 1 is filled-up with clothes, more clothes can be stacked up, and the laundry bag 1 can be loaded with a lot of clothes after being tightened with the elastic rope 8. Certainly, the present disclosure can not only be used to hold clothes, it can also be used to hold other items, which is not limited.

Specifically, it is best for mounting of the rolling wheels 4 to have a hard base 5 or base plate as support, but the hard base 5 may occupy a quite big room when folded for storage, a solution of the present disclosure is as following: the laundry bag includes a detachable base 5 disposed at the bottom of the bag body 1, the rolling wheels 4 are arranged at a bottom of the base 5, and the laundry bag further includes a first hook-and-loop fastener 6 disposed at the base 5, and a second hook-and-loop fastener 7 disposed at the bottom of the bag body 1 correspondingly to the first hook-and-loop fastener 6. The attachment of the first hook-and-loop fastener 6 and the second hook-and-loop fastener 7 can realize detachment of the base 5 from the bag body 1. Certainly, as an expanded embodiment, the base 5 and the bag body 1 can also be fixed using other detachable fixing structures, for example, by means of magnet attraction or screw fixing, etc. Herein, the rolling wheels 4 are mounted to the bottom of the base 5, and the base 5 is detachably connected to the bag body 1, in this way, the bag body 1 can be packaged separately with the base 5 after being folded for storage, which saves freight and room to place at home.

Embodiment 2: the above described embodiment 1 discloses a laundry bag with a detachable base 5, when the laundry bag is required to be stored during producing and delivering by manufacturers or when users finish using the laundry bag, a folding for storage mechanism is required. In this embodiment, basing on the embodiment 1, the laundry bag includes support rings 9 disposed at inner layers of an upper end and a lower end of each sidewall (except a top and a bottom of the bag body 1) of the bag body 1 (preferably, the bag body 1 has a cube structure with an opening on a top), each of the supporting rings 9 has a shape of rounded rectangular and is embedded into the inner layers of the side walls of the bag body 1. There is no intersection between adjacent two of the supporting rings 9, therefore the adjacent two of the support rings 9 can be rotated and folded relatively to each other. The supporting rings 9 are capable of supporting when the bag body 1 is unfolded, and rotating and folding become possible between the adjacent two of the support rings 9 when the bag body 1 is to be folded for storage, and finally realize folding for storage of an entire one of the bag body 1. For details, please refer to attached drawings. It should be noted that after the four side walls of the bag body 1 are closed, there still be a bottom, and the bottom is connected to the base 5 through the hook-and-loop fasteners, so the bag body 1 will not be loosened or turned over after being unfolded.

Specifically, as laundry bags for home use, users can directly carry or pull the top of the bag body 1 with their hands. However, if there is a requirement to take clothes to a laundry outside home for cleaning, a trolley 10 is needed. In another embodiment of the present disclosure, the laundry bag includes the trolley 10 disposed at a back of the bag body 1, a trolley holding belt 11 capable of preventing a body of the trolley 10 from shaking are disposed at an upper part of the bag body 1 correspondingly to the trolley 10. As an embodiment showing subsequent improvements, the trolley 10 and the bag body 1 can also be configured to be detachable, specifically in a snap-button way. A press type spring switch is used at where the trolley 10 and the bag body 1 connect to each other.

Specifically, in embodiment 1, when the base 5 and the bag body 1 are fixed to each other, the users are directly pull the bag body 1 for moving instead of the base 5, when clothes are overweighed, it is easy to crack between the bag body 1 and the base 5. The solution of the present disclosure is as following: the laundry bag includes a first connector 12 disposed on the base 5, and a second connector 13 capable of being movably connected to the first connector 12 disposed at the bottom of the bag body 1 correspondingly to the first connector 12, and the base 5 and the bag body 1 are capable of being locked via the first connector 12 and the second connector 13 after being fixed by the first hook-and-loop fastener 6 and the second hook-and-loop fastener 7 to prevent the bag body 1 from detaching or falling from the base. Specifically, the first connector 12 is a male button portion of a latch, and the second connector 13 is a female button portion of the latch. Certainly, the first connector 12 and the second connector 13 can also be hook-and-loop fasteners, preferably, both the first connector 12 and the second connector 13 are symmetrically arranged on two sides, so that the bag body 1 and the base 5 can be reinforced both from front and back after being connected.

Specifically, the laundry bag includes a main handle 14 disposed at an upper end of the bag body 1, and a side handle 15 disposed on a different side from the main handle 14 of the bag body 1. Preferably, both numbers of the main handle 14 and the side handle 15 are two, both two of the main handle 14 and both two of the side handle 15 are distributed on two opposite sides of the bag body 1. The main handle 14 is connected to a connecting buckle 16 capable of fastening the bag body 1 and the capacity expansion layer 3 after being filled up with clothes for tightening. The connecting buckle 16 are the male button portion and the female button portion connected to the main handles 14 on both sides, respectively (certainly, the connecting buckle 16 can also be directly connected to edges of the upper end of the bag body 1, which is mainly for the purpose of holding or tightening the capacity expansion layer 3 filled up of clothes to prevent loosening), so as to prevent the top of the laundry bag 1 from loosening. Additionally, for users who prefer to carry, the present disclosure also provides an embodiment with straps 17, the straps 17 are located in the back of the bag body 1, and the main handle 14 is disposed exactly upon the straps 17. Moreover, in order to provide more storage bags to the laundry bag to receive some articles or small items that do not need to be used frequently, such as ropes, bag accessories, etc., the laundry bag includes a side bag disposed on an outer side of the bottom pull window 2 for the convenience of receiving other items, and closure of the side bag is realized via a second zipper 19.

The foregoing descriptions are merely preferred exemplary embodiments of the present invention, but not intended to limit the present invention in any form. Any changes and modifications made by the technicians skilled in the art without departing from the technical solution of the present invention will fall within the scope of the protection of the present invention.

What is claimed is:

1. A high-capacity laundry bag convenient for dragging and taking clothes, and foldable for storage, comprising a bag body, wherein the laundry bag further comprises:

a bottom pull window convenient for reaching out for clothes, disposed on a side of a bottom of the bag body, a capacity expansion layer capable of expanding clothes holding capacity, disposed at a top of the bag body, and rolling wheels capable of supporting and moving the bag body, disposed at the bottom of the bag body;

wherein the laundry bag comprises support rings disposed at inner layers of an upper end and a lower end of each sidewall of the bag body, the support rings are capable of providing support when the bag body is unfolded, and the support rings are capable of rotating and folding between adjacent two of the support rings when the bag body is folded for storage, so as to finally realize folding for storage of an entire one of the bag body.

2. The high-capacity laundry bag convenient for dragging and taking clothes, and foldable for storage according to claim 1, wherein the laundry bag comprises a trolley disposed at a back of the bag body, and a trolley holding belt capable of preventing a body of the trolley from shaking disposed at an upper part of the bag body correspondingly to the trolley.

3. The high-capacity laundry bag convenient for dragging and taking clothes, and foldable for storage according to claim 2, wherein the laundry bag comprises a main handle disposed at an upper end of the bag body, and a side handle disposed on a different side from the main handle of the bag body, and the main handle is connected to a connecting buckle capable of tightening the bag body and the capacity expansion layer after being filled up with clothes to prevent a top of the laundry bag from loosening.

4. The high-capacity laundry bag convenient for dragging and taking clothes, and foldable for storage according to claim 3, wherein the laundry bag further comprises a strap located in the back of the bag body, and the main handle is disposed at an upper end of the strap.

5. The high-capacity laundry bag convenient for dragging and taking clothes, and foldable for storage according to claim 1, wherein closure of the bottom pull window is realized via a first zipper.

6. The high-capacity laundry bag convenient for dragging and taking clothes, and foldable for storage according to claim 5, wherein the laundry bag comprises a side bag disposed on an outer side of the bottom pull window, and closure of the side bag is realized via a second zipper.

* * * * *